US007854502B2

(12) United States Patent
Nakashima

(10) Patent No.: US 7,854,502 B2
(45) Date of Patent: Dec. 21, 2010

(54) INK-JET RECORDING APPARATUS

(75) Inventor: Atsuhisa Nakashima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 946 days.

(21) Appl. No.: 11/619,532

(22) Filed: Jan. 3, 2007

(65) Prior Publication Data

US 2007/0153076 A1 Jul. 5, 2007

(30) Foreign Application Priority Data

Jan. 4, 2006 (JP) ..... 2006-000087

(51) Int. Cl.
*B41J 2/01* (2006.01)

(52) U.S. Cl. ..... 347/104; 347/101

(58) Field of Classification Search ..... 347/104; 400/635

See application file for complete search history.

(56) References Cited

U.S. PATENT DOCUMENTS

| | | | | |
|---|---|---|---|---|
| 6,916,052 | B2 | 7/2005 | Yamada et al. | |
| 7,021,756 | B2 | 4/2006 | Nakashima et al. | |
| 2004/0022557 | A1* | 2/2004 | Kudo | 399/167 |
| 2004/0114019 | A1* | 6/2004 | Nakashima | 347/104 |
| 2004/0228669 | A1* | 11/2004 | Nakashima et al. | 400/635 |
| 2004/0246324 | A1* | 12/2004 | Nakashima | 347/104 |
| 2004/0263560 | A1* | 12/2004 | Nakashima | 347/32 |

FOREIGN PATENT DOCUMENTS

| | | | |
|---|---|---|---|
| JP | S61-206534 | U | 12/1986 |
| JP | H07-164697 | A | 6/1995 |
| JP | H11-020972 | A | 1/1999 |
| JP | 2002-211060 | A | 7/2002 |
| JP | 2003-195666 | A | 7/2003 |
| JP | 2004-043047 | A | 2/2004 |
| JP | 2004-262204 | A | 9/2004 |
| JP | 2004-331272 | A | 11/2004 |
| JP | 2005-096290 | A | 4/2005 |
| WO | 03/076319 | A1 | 9/2003 |

OTHER PUBLICATIONS

Japan Patent Office, Notice of Reasons for Rejection for Patent Application No. JP 2006-000087, mailed Jan. 6, 2009. (Abridged Translation) (Counterpart to above-captioned U.S. patent application).

* cited by examiner

*Primary Examiner*—Matthew Luu
*Assistant Examiner*—Kendrick X Liu
(74) *Attorney, Agent, or Firm*—Baker Botts, LLP

(57) ABSTRACT

An ink-jet recording apparatus comprises rollers, an endless conveyor belt, a nip roller, and an ink-jet head. The endless conveyor belt is stretched between the rollers. The nip roller cooperates with an outer surface of the conveyor belt to sandwich a recording medium. The ink-jet head has nozzles from which ink is ejected to the recording medium that is conveyed in a predetermined conveyance direction by the conveyor belt. The conveyor belt has a base member, an elastic layer formed on an outer surface of the base member, and an adhesive layer formed on an outer surface of the elastic layer and holding thereon the recording medium. The elastic layer deforms in its thickness direction when the recording medium is sandwiched between the adhesive layer and the nip roller.

11 Claims, 5 Drawing Sheets

INK-JET RECORDING APPARATUS

BACKGROUND OF THE INVENTION

1. Field of the Invention

The present invention relates to an ink-jet recording apparatus that ejects ink to a recording medium and thus performs printing.

2. Description of Related Art

Japanese Patent Unexamined Publication No. 2002-211060 discloses an ink-jet recording apparatus in which a paper serving as a recording medium is placed on a conveyance section set at a specific position of a conveyor belt, and ink is ejected from a recording head to the paper so that marginless printing is performed. The conveyance section protrudes from the conveyor belt. The paper is placed on the conveyance section and not in contact with the conveyor belt. Accordingly, even if in marginless printing ink going outside the paper adheres to the conveyor belt, a back surface of the paper is not stained with the ink.

SUMMARY OF THE INVENTION

However, in the ink-jet recording apparatus disclosed in the above-mentioned document, a paper is merely sandwiched between the conveyance section and a conveyance roller. If the paper is uneven in its thickness direction or if a face of the conveyance section in contact with a paper is uneven, and the like, adhesion between the paper and the conveyance section deteriorates. As a result, the paper is easily separated from the conveyance section, to make paper conveyance unstable.

An object of the present invention is to provide an ink-jet recording apparatus that can improve adhesion between a conveyor belt and a recording medium to realize stable conveyance of the recording medium.

According to an aspect of the present invention, there is provided an ink-jet recording apparatus comprising a plurality of rollers, an endless conveyor belt, a nip roller, and an ink-jet head. The endless conveyor belt is stretched between the rollers. The nip roller cooperates with an outer surface of the conveyor belt to sandwich a recording medium. The ink-jet head has a plurality of nozzles from which ink is ejected to the recording medium that is conveyed in a predetermined conveyance direction by the conveyor belt. The conveyor belt has a base member, an elastic layer formed on an outer surface of the base member, and an adhesive layer formed on an outer surface of the elastic layer and holding thereon the recording medium. The elastic layer deforms in its thickness direction when the recording medium is sandwiched between the adhesive layer and the nip roller.

In the aspect, even if the outer surface of the conveyor belt and/or the recording medium are/is uneven, the elastic layer deforms so as to absorb unevenness, to ensure that the recording medium is in contact with the outer surface of the conveyor belt and held by the adhesive layer. This allows the recording medium to be conveyed stably.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

In the following, some preferred embodiments of the present invention will be described with reference to the accompanying drawings.

Figure 1:
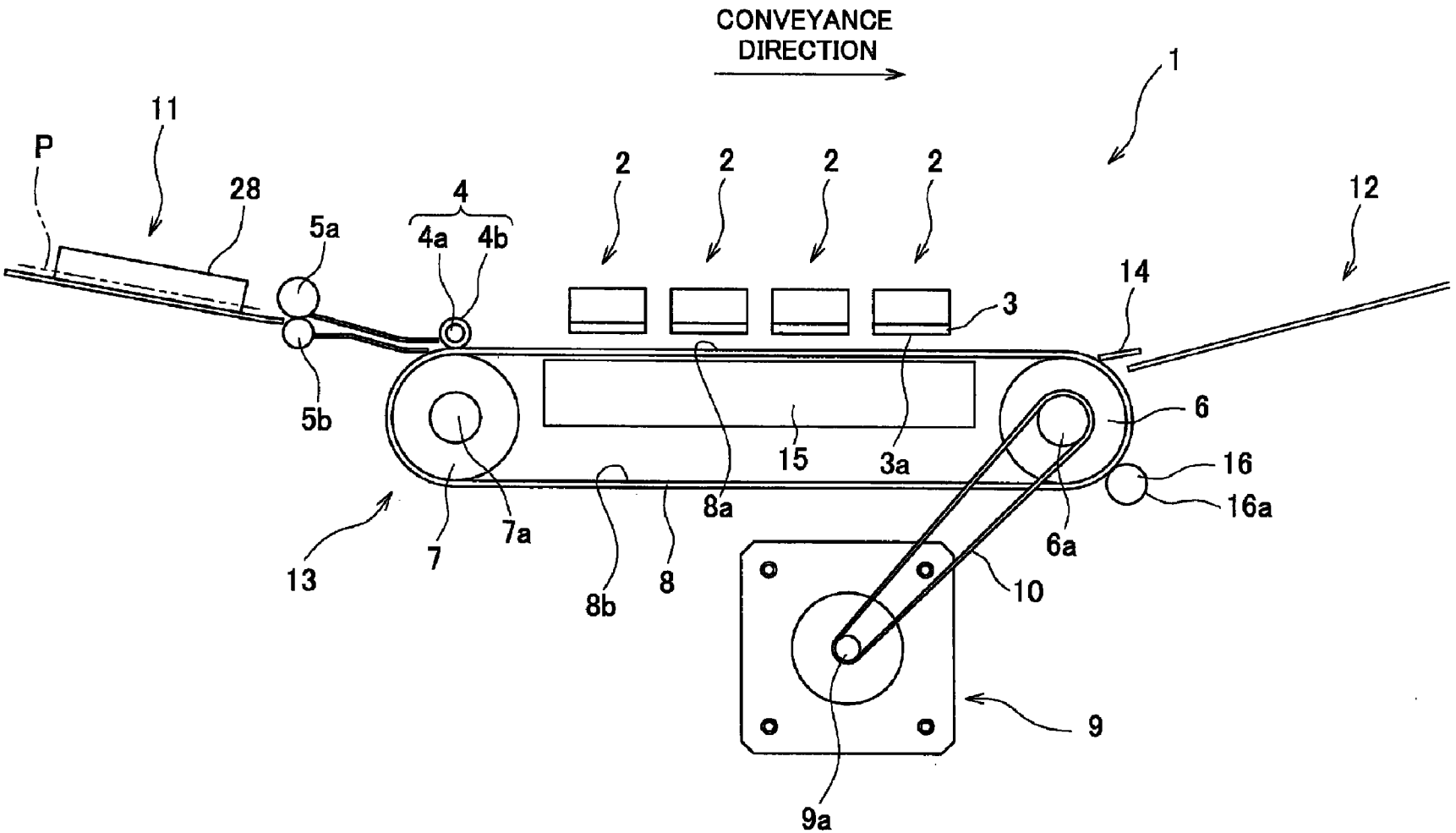
FIG. 1 is a schematic side view showing a general construction of an ink-jet printer according to a first embodiment of the present invention.

FIG. 1 is a schematic side view showing a general construction of an ink-jet printer according to a first embodiment of the present invention. As shown in FIG. 1, an ink-jet printer 1 is a color ink-jet printer having four ink-jet heads 2. The ink-jet printer 1 has a paper feed unit 11 at a left side in FIG. 1, and a paper discharge unit 12 at a right side in FIG. 1.

A paper conveyance path on which a paper P is conveyed from the paper feed unit 11 to the paper discharge unit 12 is formed inside the ink-jet printer 1. A pair of feed rollers 5*a* and 5*b* is disposed immediately downstream of the paper feed unit 11. The pair of feed rollers 5*a* and 5*b* conveys the paper P while pinching the paper P. By the pair of feed rollers 5*a* and 5*b*, the paper P is sent out from the paper feed unit 11 to a right side in FIG. 1. A belt conveyor mechanism 13 is provided in the middle of the paper conveyance path. The belt conveyor mechanism 13 includes two belt rollers 6, 7, an endless conveyor belt 8, and a platen 15. The conveyor belt 8 is wound on the belt rollers 6 and 7 so as to be stretched between them. In a region enclosed by the conveyor belt 8, the platen 15 is disposed at a position opposed to the ink-jet heads 2. The platen 15 is disposed with its upper face coming close to an inner surface 8*b* of an upper part of the conveyor belt 8. The platen 15 supports the conveyor belt 8 to prevent the conveyor belt 8 from being bent in its portion opposed to the ink-jet heads 2. Rotation shafts 6*a* and 7*a* of the belt rollers 6 and 7 are disposed in a direction perpendicular to a paper conveyance direction (hereinafter referred to as a "conveyance direction") and in parallel to each other. A nip roller 4 is disposed at a position opposed to the belt roller 7. A rotation shaft 4*a* of the nip roller 4 extends in parallel to the rotation shafts 6*a* and 7*a* of the belt rollers 6 and 7. The nip roller 4 has an elastic member 4*b* of cylindrical shape formed on an outer surface of the rotation shaft 4*a*. The elastic member 4*b* is radially deformable. The nip roller 4 presses the paper P, which is sent out from the paper feed unit 11 by the feed rollers 5*a* and 5*b*, onto an outer surface 8*a* of the conveyor belt 8.

As shown in FIG. 1, a conveyor motor 9 is disposed below the conveyor belt 8. A drive belt 10 is stretched between a shaft 9*a* of the conveyor motor 9 and the rotation shaft 6*a* of the belt roller 6. As the shaft 9*a* of the conveyor motor 9 rotates clockwise in FIG. 1, the belt roller 6 is driven in clockwise rotation. Along with rotation of the belt roller 6, the conveyor belt 8 stretched between the belt rollers 6 and 7 travels in the conveyance direction. The outer surface 8*a* of the conveyor belt 8 on which the paper P is placed has adhesiveness. This enables the paper P pressed onto the outer surface 8*a* by the nip roller 4 to be conveyed to the paper discharge unit 12 while being held on the conveyor belt 8 by the adhesiveness of the outer surface 8*a*.

A peeling plate 14 is disposed immediately downstream of the belt roller 6 in the paper conveyance path. The peeling plate 14 peels off the paper P, which is adhesively held on the outer surface 8*a* of the conveyor belt 8, from the outer surface 8*a* and sends the paper P to the paper discharge unit 12.

An adhesive roller 16 is disposed on a lower right side of the belt roller 6 so as to be in contact with the outer surface 8*a* of the conveyor belt 8. The conveyor belt 8 is sandwiched between the adhesive roller 16 and the belt roller 6. An outer surface 16*a* of the adhesive roller 16 is treated with silicone for example, and therefore given adhesiveness. In this embodiment, the adhesiveness of the outer surface 16*a* of the adhesive roller 16 is larger than that of the outer surface 8*a* of the conveyor belt 8. Therefore, the adhesive roller 16 can remove foreign materials such as paper dust adhering to the outer surface 8*a* of the conveyor belt 8.

The four ink-jet heads 2 are arranged side by side along the conveyance direction, and eject magenta ink, yellow ink, cyan ink, and black ink, respectively. That is, the ink-jet printer 1 is a line-type printer. Each of the ink-jet heads 2 has, at its lower end, a head main body 3 of rectangular shape elongated in a direction perpendicular to the conveyance direction. The head main body 3 is made of a passage unit and an actuator bonded to each other. Ink passages each including a nozzle and a pressure chamber are formed in the passage unit. The actuator gives pressure to ink contained in the pressure chamber. Many small-diameter nozzles from which ink is ejected downward are formed on a bottom face of the head main body 3, so that the bottom face serves as an ink ejection face 3*a* opposed to the outer surface 8*a*.

The head main body 3 is disposed in such a manner that the ink ejection face 3*a* lies in parallel to the outer surface 8*a* of the conveyor belt 8 in its upper loop, that is, a portion of the outer surface 8*a* opposed to the ink-jet head 2, with a narrow gap being formed between the ink ejection face 3*a* and the outer surface 8*a*. The paper conveyance path extends through the gap. When the paper P conveyed by the conveyor belt 8 passes immediately under the four head main bodies 3, ink of respective colors is ejected from the nozzles of the head main bodies 3 to an upper face or a printing face of the paper P, thus forming a desired color image on the paper P.

Figure 2:
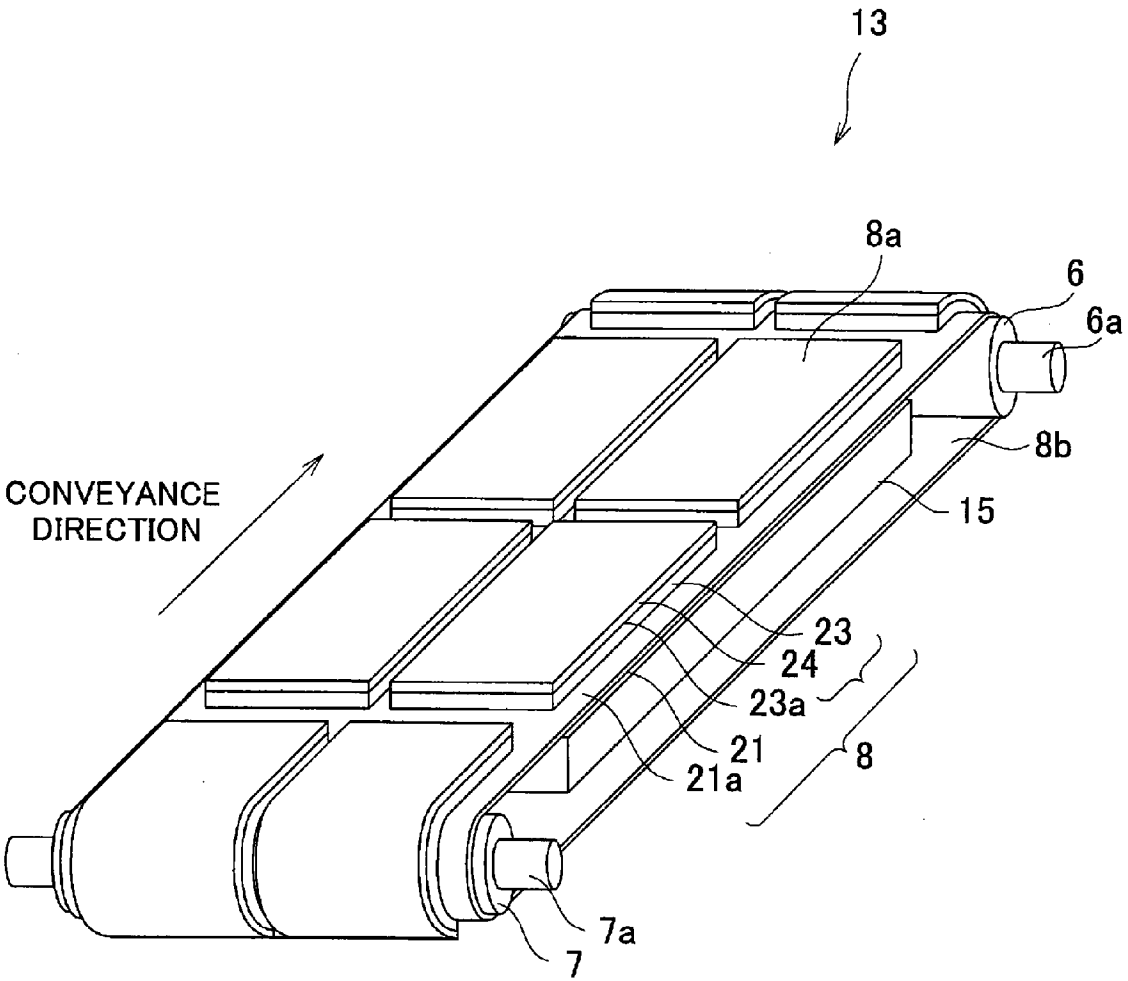
FIG. 2 is a schematic perspective view of a belt conveyor mechanism that is included in the ink-jet printer shown in FIG. 1.
Figure 3:
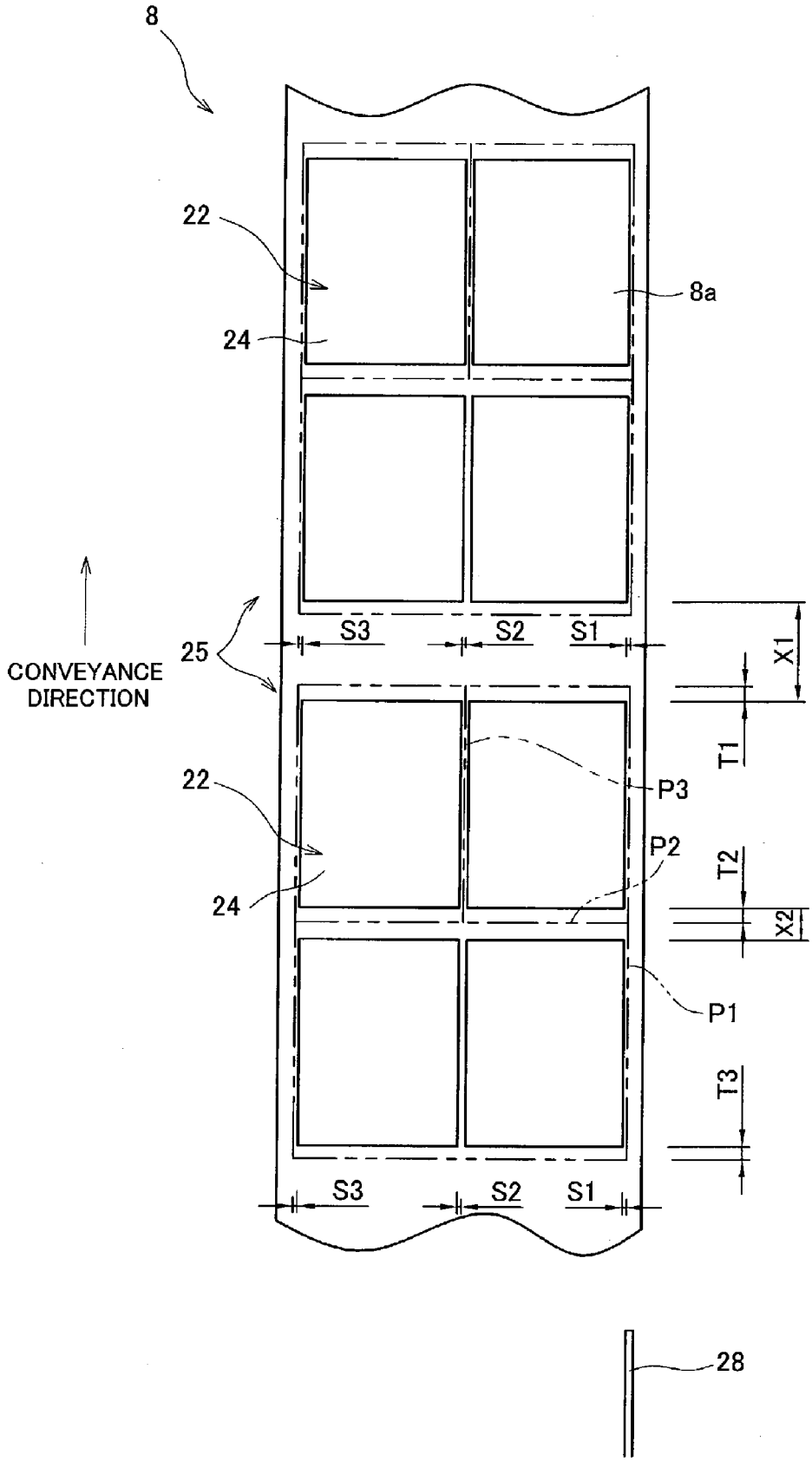
FIG. 3 is a plan view on an enlarged scale of a part of a conveyor belt that is included in the belt conveyor mechanism.

Next, the conveyor belt 8 of the belt conveyor mechanism 13 will be described into details with reference to FIGS. 2 and 3. FIG. 2 is a schematic perspective view of the belt conveyor mechanism 13. FIG. 3 is a plan view on an enlarged scale of a part of the conveyor belt 8. As shown in FIG. 2, the conveyor belt 8 has a film-like base member 21 and island protrusions 22. The base member 21 is stretched between the belt rollers 6 and 7. The island protrusions 22 protrude outward from an outer surface 21*a* of the base member 21.

The base member 21 is made of a film-like member with a small elongation such as metals, polyethylene terephthalate resins, polyimide resins, polycarbonate resins and the like, or alternatively made of a mesh member with a small elongation interweaved with polyester fibers. The protrusion 22 includes an elastic layer 23 formed on the outer surface 21*a* of the base member 21, and an adhesive layer 24 formed on an outer surface 23*a* of the elastic layer 23. The elastic layer 23 is for example made of a low-hardness rubber such as urethane, ethylene propylene, and the like, or alternatively made of an acrylic, urethane, or silicone-based porous expanded material. The elastic layer 23 has a thickness of approximately 0.5 to 1.0 mm. When external force is applied, the elastic layer 23 can deform so as to reduce its thickness by approximately 0.1 mm or more. The adhesive layer 24 is for example made of a low-hardness silicone coating, or alternatively made of an urethane resin or an acrylic resin including fine cells. A surface of the adhesive layer 24 is equivalent to the outer surface 8*a* of the conveyor belt 8, and given adhesiveness. Since the surface of the adhesive layer 24 has adhesiveness, the paper P can surely be held on the adhesive layer 24.

As shown in FIGS. 2 and 3, all the protrusions 22 have the same shape in a plan view. Four protrusions 22 neighboring to each other constitute a protrusion group 25. In this embodiment, as shown in FIG. 3, each of three kinds of papers P1 of A4 size, P2 of A5 size, and P3 of A6 size is, in its region except front, rear, and both side ends with respect to the conveyance direction, held from below by four protrusions 22 that constitute each protrusion group 25. That is, each of the papers P1 to P3 is, in its region inner than the front, rear, and both side ends, held from below by the four protrusions 22 that constitute each protrusion group 25. The papers P1 to P3 are different in length with respect to either one of the conveyance direction and the direction perpendicular to the conveyance direction.

Positions and sizes of the four protrusions 22 constituting each protrusion group 25 are determined in such a manner that the four protrusions 22 overlap none of four ends of the paper P1 to P3 placed on the conveyor belt 8 but overlap a region of the paper P1 to P3 inner than its four ends. As a consequence, each protrusion 22 is covered with any of the papers P1 to P3. Therefore, when marginless printing is performed on the paper P1 to P3, ink ejected around a periphery of the paper P1 to P3 and thus coming outside the paper P1 to P3 does not adhere to the surface 8*a* of the protrusion 22. Accordingly, another paper P1 to P3 can be held on the surface 8*a* of the same protrusion 22, without its back surface being stained with ink.

The four protrusions 22 constituting each protrusion group 25 overlap a region of each of the papers P1 to P3 except front, rear, and both side ends, in such a manner that the front, rear, and both side ends of each of the papers P1 to P3 do not bend toward the surface 21*a* of the base member 21 due to its own weight. Accordingly, even when ink is adhering to the surface 21*a* of the base member 21, the paper P is not stained with the ink adhering to the surface 21*a* of the base member 21 because the front, rear, and both side ends of the paper P do not bend into contact with the surface 21*a*.

When the papers P1 to P3 are held by the four protrusions 22 constituting each protrusion group 25, intervals T1, T2, and T3 are formed between the protrusions 22 and the front and rear ends of the papers P1 to P3 with respect to the conveyance direction, and intervals S1, S2, and S3 are formed between the protrusions 22 and the both side ends of the papers P1 to P3 with respect to the direction perpendicular to the conveyance direction. Any of the intervals T1, T2, and T3 is larger than the intervals S1, S2, and S3. In this embodiment, a guide plate 28 extending in parallel to the conveyance direction is provided in the paper feed unit 11. Any one of side ends of a paper P extending in the conveyance direction is laid along the guide plate 28, so that the paper P is put into position with respect to the direction perpendicular to the conveyance direction. Therefore, even though the intervals S1 to S3 are narrow, the papers P1 to P3 can be placed on the protrusion group 25 with good accuracy so as to form the intervals S1 to S3, as shown in FIG. 3. While the conveyor belt 8 is traveling, the papers P1 to P3 are placed onto the protrusion group 25 and conveyed. Since any of the intervals T1 to T3 is larger than the intervals S1 to S3, there is a timing margin for the papers P1 to P3 to be sent out. That is, even though the papers P1 to P3 are sent out to the protrusion group 25 with a little timing lag, the surface 8*a* of the protrusion 22 is not exposed at the front and rear ends of the papers P1 to P3.

An interval X1 that is formed between neighboring protrusion groups 25 with respect to the conveyance direction is larger than an interval X2 that is formed between four protrusions 22 constituting each protrusion group 25 with respect to the conveyance direction. Consequently, when a paper P1 is placed on each protrusion group 25 and conveyed one by one, a timing for sending out the paper P1 obtains a margin and besides neighboring papers P1 do not interfere with each other.

Figure 4A:
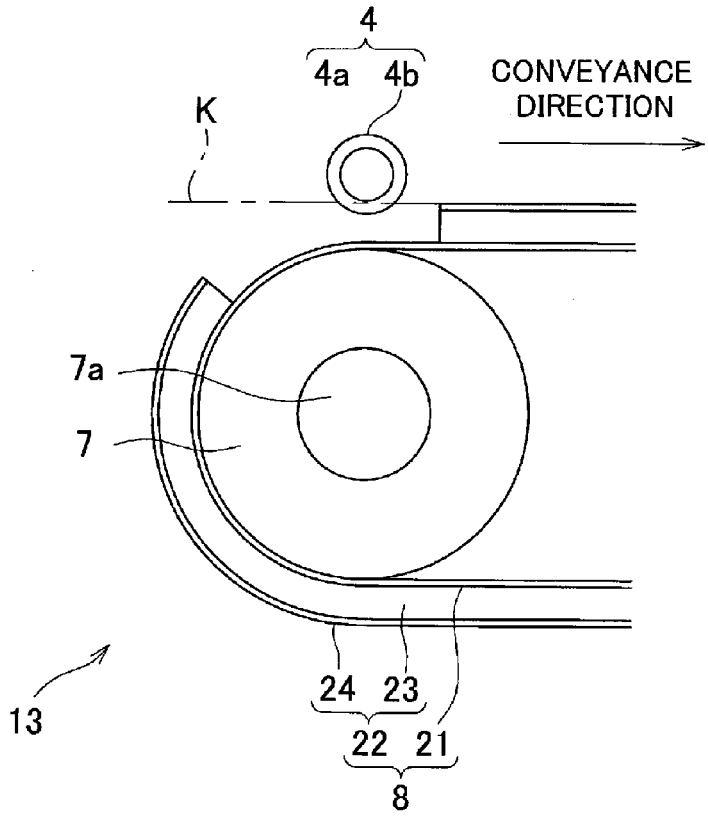
FIG. 4A illustrates a situation before a paper is held on an outer surface of the conveyor belt.
Figure 4B:
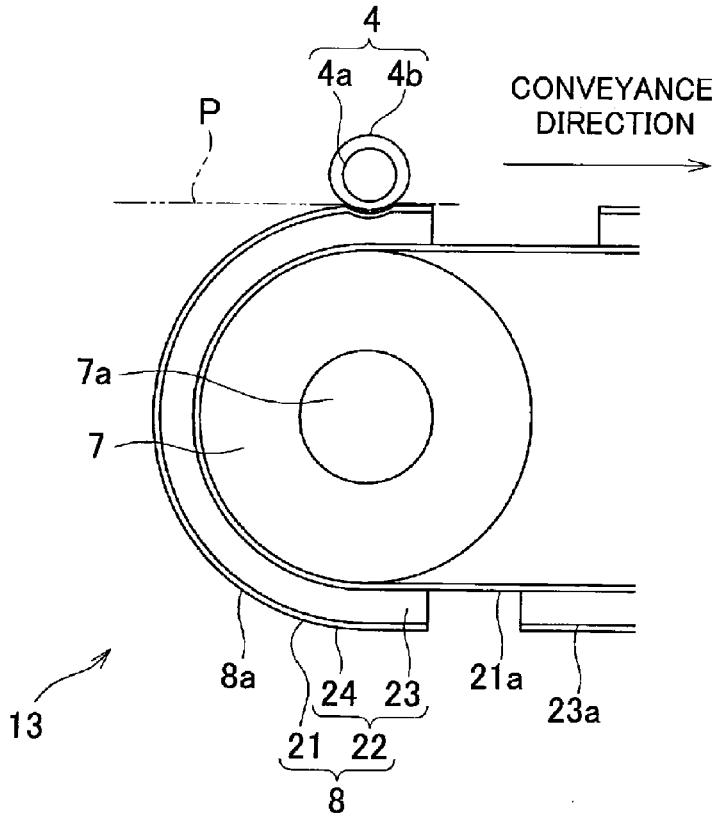
FIG. 4B illustrates a situation where a paper is held on the outer surface of the conveyor belt.

Next, a positional relation between the belt conveyor mechanism 13 and the nip roller 4 will be described below. FIG. 4A illustrates a situation before the paper P is held on the outer surface of the conveyor belt 8. FIG. 4B illustrates a situation where the paper P is held on the outer surface of the conveyor belt 8. As shown in FIG. 4A, the rotation shaft 4*a* of the nip roller 4 is, with respect to an up-and-down direction of FIG. 4A, in line with a center of the rotation shaft 7*a* of the belt roller 7. An imaginary line K, which extends along the outer surface 8*a* of the conveyor belt 8 in its upper loop as illustrated with an alternate long and short dash line in FIG. 4A, exists between the outer surface of the rotation shaft 4*a* and an outer surface of the elastic member 4*b* with respect to a direction connecting centers of the respective rotation shafts 4*a* and 7*a*. Thus, when the conveyor belt 8 travels in the conveyance direction to bring the protrusion 22 to a position between the rotation shaft 4*a* and the rotation shaft 7*a*, as shown in FIG. 4B, the nip roller 4 and the protrusion 22 gets into deformation contact with each other.

Immediately before, by the conveyor belt 8 traveling in the conveyance direction, a front end of leading one of protrusions 22 of the protrusion group 25 which means a front end of a protrusion 22 mostly overlapping the belt roller 7 in FIG. 4B is brought to a position between the rotation shaft 4*a* and the rotation shaft 7*a*, the feed rollers 5*a* and 5*b* send out a front end of a paper P to between the rotation shaft 4*a* and the rotation shaft 7*a*. Thus, as shown in FIG. 4B, the front end of the paper P is not sandwiched between the nip roller 4 and the protrusion 22, but a portion of the paper P inner than the front end is sandwiched between the nip roller 4 and the protrusion 22. At this time, both side ends of the paper P do not overlap the protrusion 22, and therefore are not sandwiched between the nip roller 4 and the protrusion 22. Moreover, in a state where the nip roller 4 and the protrusion 22 sandwich the paper P therebetween, the elastic member 4*b* of the nip roller 4 and the elastic layer 23 of the protrusion 22 are deformably contracted by approximately 0.1 mm and approximately 0.1 mm, respectively, as compared with in a state where the nip roller 4 and the protrusion 22 are not in contact with each other. Since the elastic member 4*b* and the elastic layer 23 are deformed by approximately 0.2 mm in total, the paper P is surely held on the surface 8*a* of the protrusion 22, that is, on the surface 8*a* of the conveyor belt 8.

When the conveyor belt 8 travels while a front portion of the paper P is held by the protrusion 22, a region of the paper P except a rear end thereof, which overlaps the protrusion 22, sequentially gets sandwiched between the nip roller 4 and the protrusion 22. In this way, a region of the paper P except front, rear, and both side ends is held on the surface 8*a* of the protrusion 22. When the paper P held on the outer surface 8*a* of the conveyor belt 8 gets opposed to the ink-jet heads 2, ink is ejected to the paper P so that a desired image is formed on the paper P. The four protrusions 22 constituting the protrusion group 25 are formed at positions not overlapping the front, rear, and both side ends of a paper P but overlapping a region of the paper P inner than the front, rear, and both side ends, whichever size A4, A5, or A6 the conveyed paper P has. When the feed rollers 5*a* and 5*b* send out the paper P at the above-described timing, the region of the paper P inner than the front, rear, and both side ends is adhesively held on the surface 8*a* of the protrusion 22.

As thus have been described above, in the ink-jet printer 1 of this embodiment, the conveyor belt 8 has the elastic layer 23. Accordingly, even if the outer surface 8*a* of the conveyor belt 8 and/or the paper P are/is uneven, the elastic layer 23 deforms so as to absorb unevenness, to ensure that the paper P is in contact with the outer surface 8*a* of the conveyor belt 8 and held by the adhesive layer 24. This allows the paper P to be conveyed stably.

Since the elastic layer 23 deforms in a thickness direction by approximately 0.1 mm or more, the paper P can be held more stably. In addition, the nip roller 4 has the elastic member 4*b* formed on its outer surface, and the nip roller 4 and the elastic layer 23 deform altogether by approximately 0.2 mm in total, which is larger than 0.1 mm and therefore enables the paper P to be held further more stably.

Moreover, since the protrusions 22 have the same shape in a plan view, the conveyor belt 8 has a simple structure and thus can easily be manufactured.

Figure 5:
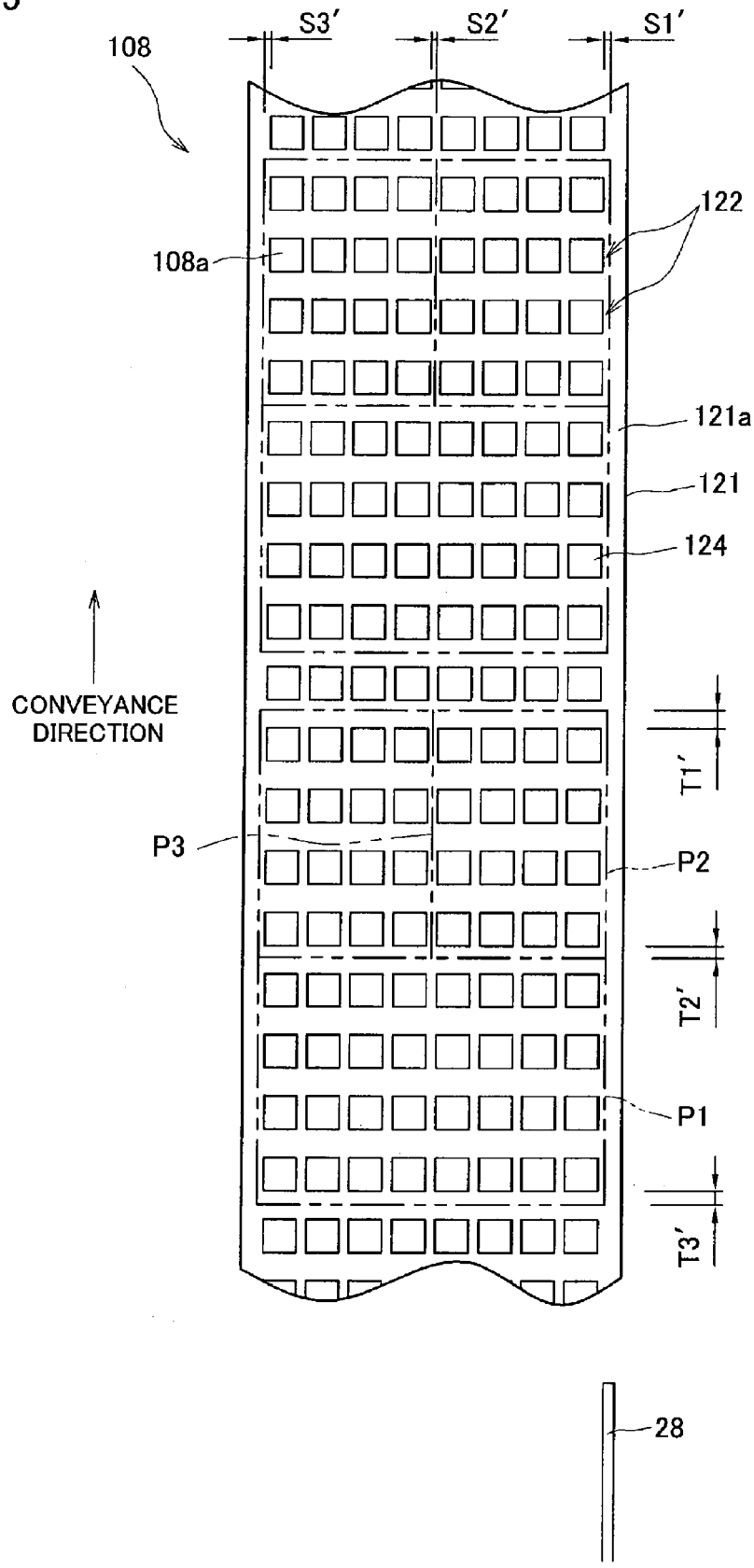
FIG. 5 is a plan view on an enlarged scale of a part of a conveyor belt that is applied to an ink-jet printer according to a second embodiment of the present invention.

Next, an ink-jet printer according to a second embodiment of the present invention will be described below. FIG. 5 is a plan view on an enlarged scale of a part of a conveyor belt 108 that is applied to an ink-jet printer according to a second embodiment of the present invention. An ink-jet printer of this embodiment is the same as that of the first embodiment except that the conveyor belt 108 applied thereto has a construction different from that of the conveyor belt 8 of the first embodiment. Therefore, in the following, only the conveyor belt 108 will be described.

As shown in FIG. 5, the conveyor belt 108 has a base member 121 and island protrusions 122. The base member 121 is similar to the base member 21 of the first embodiment. The island protrusions 122 protrude outward from an outer surface 121*a* of the base member 121. The protrusion 122 includes an elastic layer formed on the outer surface 121*a* of the base member 121, and an adhesive layer 124 formed on an outer surface of the elastic layer. FIG. 5 does not illustrate the elastic layer which is hidden behind the adhesive layer 124. The protrusion 122 is substantially the same as the protrusion 22 of the first embodiment except that in a plan view a size of the protrusion 122 is smaller than the size of the protrusion 22. That is, materials of the elastic layer and the adhesive layer 124 are the same as those of the elastic layer 23 and the adhesive layer 24 of the first embodiment.

Throughout the outer surface 121*a* of the base member 121, the protrusions 122 are arranged at regular intervals with respect to a conveyance direction and a direction perpendicular to the conveyance direction. As shown in FIG. 5, the protrusions 122 are disposed so as to partially hold from below a region of each of three kinds of papers P1 to P3 except front, rear, and both side ends thereof with respect to the conveyance direction. As a consequence, each protrusion 122 is covered with any of the papers P1 to P3. Therefore, when marginless printing is performed on the paper P1 to P3, ink ejected around a periphery of the paper P1 to P3 and thus coming outside the paper P1 to P3 does not adhere to the surface 108*a* of the protrusion 122. Accordingly, similarly to in the first embodiment, another paper P1 to P3 can be held on the surface 108*a* of the same protrusion 122, without its back surface being stained with ink.

When the papers P1 to P3 are held by the protrusions 122, intervals T1', T2', and T3' are formed between the protrusions 122 and the front and rear ends of the papers P1 to P3 with respect to the conveyance direction, and intervals S1', S2', and S3' are formed between the protrusions 122 and the both side ends of the papers P1 to P3 with respect to the direction perpendicular to the conveyance direction. Any of the intervals T1', T2', and T3' is larger than the intervals S1', S2', and S3'. Accordingly, similarly to in the first embodiment, there occurs a timing margin for the papers P1 to P3 to be sent out to the protrusions 122. Therefore, even if the timing lags a little, the surface 8*a* of the protrusion 122 is not exposed at the front and rear ends of the papers P1 to P3.

By applying the above-described conveyor belt 108 to an ink-jet printer, the three kinds of papers P1 to P3 can be sent out to the conveyor belt 108 and conveyed while being adhesively held by the protrusions 122. Since the protrusion 122 has the same elastic layer as the elastic layer 23 of the first embodiment, the same effects as of the above-described elastic layer 23 can be obtained.

Unlike the above-described protrusions 22 included in the protrusion group 25, the protrusions 122 of this embodiment are not formed concentratedly in a certain region. It is therefore not necessary that a paper P is sent out to every protrusion group 25 as in the first embodiment. To be more specific, it suffices that, immediately before protrusions 122 arranged in the direction perpendicular to the conveyance direction comes to a position between a center of a rotation shaft 4*a* of a nip roller 4 and a rotation shaft 7*a* of a belt roller 7 shown in FIGS. 4A and 4B, a front end of a paper P is sent out to between the rotation shaft 4*a* and the rotation shaft 7*a*. That is, the number of timings for a paper P to be sent out to the conveyor belt 108 is equal to the number of rows of protrusions 122 that are arranged in the direction perpendicular to the conveyance direction. Thus, there are an increased number of timings for a paper P to be sent out during a printing operation. This contributes to a high-speed printing. In addition, since the protrusions 122 are arranged regularly, it is easy to design the conveyor belt 108.

The conveyor belt may not necessarily have an island protrusion, as long as it has a base member, an elastic layer, and an adhesive layer.

The protrusion group may be made up of one to three protrusions, or alternatively five or more protrusions.

The protrusions 22 and 122 of the above-described embodiments are disposed so as to convey the papers P1 to P3 of three sizes A4, A5, and A6, but they may be disposed so as to additionally convey papers of B4 and B5 sizes.

The elastic layer 23 may deform in a thickness direction by less than approximately 0.1 mm. That is, it suffices that the elastic layer 23 is elastically deformable even a little.

When the nip roller 4 and the protrusion 22 sandwich the paper P therebetween as shown in FIG. 4B, each of the nip roller 4 and the elastic layer 23 deforms by approximately 0.1 mm. However, it suffices that at least the elastic layer 23 deforms by approximately 0.1 mm or more. That is, the nip roller 4 may be undeformable one not including the elastic member 4*b*. In such a case as well, the paper P can surely be held on the surface 8*a* of the protrusion 22 because, when the nip roller and the protrusion 22 sandwich the paper P therebetween, the elastic layer 23 deforms by approximately 0.1 mm or more.

The protrusions 22, 122 formed on the conveyor belt may have different shapes in a plan view.

The adhesive roller 16 may not be provided in the ink-jet printer 1.

The above-described ink-jet printer 1 is a line printer having a fixed head, but the present invention is applicable to a serial printer having a reciprocating head.

Applications of the ink-jet recording apparatus according to the present invention are not limited to printers. It is also applicable to ink-jet type facsimiles, copying machines, and the like.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink jet recording apparatus comprising:

a plurality of rollers;

an endless conveyor belt that is stretched between the rollers;

a nip roller that cooperates with an outer surface of the conveyor belt to sandwich a recording medium; and an ink jet head having a plurality of nozzles from which ink is ejected to the recording medium that is conveyed in a predetermined conveyance direction by the conveyor belt, wherein:

the conveyor belt has a base member, an elastic layer formed on an outer surface of the base member, and an adhesive layer formed on an outer surface of the elastic layer and holding thereon the recording medium;

the nip roller comprises a rotation shaft and an elastic member formed on an outer surface of the rotation shaft;

the elastic and the adhesive layers of the conveyor belt form at least one separate island protrusion;

the at least one separate island protrusion has a substantially planar shape and has a size smaller than a size of the recording medium, and the at least one separate island protrusion overlaps an inner portion of the recording medium and does not overlap any of a front end, a rear end, and both side ends of the recording medium; and the nip roller is positioned with respect to the endless conveyor belt such that:

(i) the outer surface of the rotation shaft and the outer surface of the base member are separated by a distance equal to or more than a thickness of the at least one separate island protrusion and an outer surface of the elastic member of the nip roller and the outer surface of the base member are separated by a distance equal to or less than the thickness of the at least one separate island protrusion when the at least one separate island protrusion is not positioned between the nip roller and the base member.

2. The ink-jet recording apparatus according to claim 1, wherein the elastic layer deforms in the thickness direction by 0.1 mm or more.

3. The ink-jet recording apparatus according to claim 1, wherein: the nip roller is, at least in its outer surface, made of an-elastic material; and the nip roller and the elastic layer deform altogether by 0.1 mm or more in total.

4. The ink-jet recording apparatus according to claim 1, wherein:

a protrusion group including four or more of the protrusions is formed on the base member; and the protrusions included in the protrusion group are disposed so as not to overlap front, rear, and both side ends of any of three or more kinds of recording media having different sizes but so as to overlap a region of any of the three or more kinds of recording media inner than the front, rear, and both side ends.

5. The ink jet recording apparatus according to claim 4, wherein:

a plurality of the protrusion groups are formed on the base member; and an interval with respect to the conveyance direction between neighboring protrusion groups is larger than an interval with respect to the conveyance direction between neighboring protrusions included in one of the neighboring protrusion groups.

6. The ink jet recording apparatus according to claim 1, wherein:

a plurality of the protrusions are formed on the base member; and the protrusions do not overlap front, rear, and both side ends of any of a plurality of kinds of recording media having different lengths with respect to the conveyance direction, but they overlap a region of any of the plurality of kinds of recording media inner than the front, rear, and both side ends.

7. The ink-jet recording apparatus according to claim 6, wherein the protrusions are arranged at regular intervals with respect to the conveyance direction and a direction perpendicular to the conveyance direction.

8. The ink-jet recording apparatus according to claim 1, wherein an interval with respect to the conveyance direction between the protrusion and the front end of the recording medium placed on the conveyor belt is larger than an interval with respect to a direction perpendicular to the conveyance direction between the protrusion and the side end of the recording medium.

9. The ink jet recording apparatus according to claim 4, wherein the protrusions have the same shape in a plan view.

10. The ink jet recording apparatus according to claim 4, wherein:

the protrusion group is constituted by four of the protrusions each having in a plan view a rectangular shape elongated in the conveyance direction;

the four protrusions constituting the protrusion group are arranged in two rows in any of the conveyance direction and a direction perpendicular to the conveyance direction; and when three kinds of recording media having different sizes are conveyed by the conveyor belt, the smallest one of the three kinds of recording media overlaps only one of the protrusions, the second smallest one of the three kinds of recording media overlaps only two of the protrusions neighboring each other in the direction perpendicular to the conveyance direction, and the largest one of the three kinds of recording media overlaps the four protrusions.

11. The ink-jet recording apparatus according to claim 1, further comprising an adhesive roller that has an adhesive outer surface, wherein the outer surface of the adhesive roller is in contact with the outer surface of the conveyor belt.

* * * * *